US008708260B2

(12) United States Patent
Chen et al.

(10) Patent No.: US 8,708,260 B2
(45) Date of Patent: Apr. 29, 2014

(54) DEPOWERED STANDBY PAPER SHREDDER AND METHOD

(75) Inventors: Guanlong Chen, Shanghai (CN); Yung Kang Tso, Shanghai (CN); Kevin Chen, Rancho Palos Verdes, CA (US); Chung Shih Tsai, Hawthorne, CA (US)

(73) Assignee: Aurora Office Equipment Co., Ltd., Shanghai (CN)

( * ) Notice: Subject to any disclaimer, the term of this patent is extended or adjusted under 35 U.S.C. 154(b) by 366 days.

(21) Appl. No.: 13/205,434

(22) Filed: Aug. 8, 2011

(65) Prior Publication Data

US 2013/0037637 A1 Feb. 14, 2013

(51) Int. Cl.
*B02C 23/00* (2006.01)

(52) U.S. Cl.
USPC ..... 241/36; 241/37.5

(58) Field of Classification Search
USPC ..... 241/34, 36, 375
See application file for complete search history.

(56) References Cited

U.S. PATENT DOCUMENTS

| | | | | |
|---|---|---|---|---|
| 606,596 | A | 6/1898 | Stircker | |
| 694,004 | A | 2/1902 | Doan | |
| 2,731,208 | A * | 1/1956 | Dodd | 241/41 |
| 3,010,662 | A * | 11/1961 | Johnson | 241/36 |
| 3,111,800 | A | 11/1963 | Quianthy | |
| 3,629,530 | A | 12/1971 | Fischer | |
| 3,724,766 | A | 4/1973 | Bosland | |
| 3,728,501 | A | 4/1973 | Larson et al. | |
| 3,746,815 | A | 7/1973 | Drummer | |
| 3,769,473 | A | 10/1973 | Lay | |
| 3,780,246 | A | 12/1973 | Beckering et al. | |
| 3,785,230 | A | 1/1974 | Lokey | |
| 3,829,850 | A | 8/1974 | Guetersloh | |
| 3,860,180 | A | 1/1975 | Goldhammer | |
| 3,873,796 | A | 3/1975 | Worobec | |

(Continued)

FOREIGN PATENT DOCUMENTS

| | | |
|---|---|---|
| CN | 2372057 | 4/2000 |
| CN | 2383583 | 6/2000 |

(Continued)

OTHER PUBLICATIONS

J.L. Novak & J.T. Feddema, a capacitance-based proximity sensor for whole arm obstacle avoidance, Sandia National Laboratories Albuquerque NM 87185, Dec. 1992.

(Continued)

*Primary Examiner* — Faye Francis
(74) *Attorney, Agent, or Firm* — WHGC, P.L.C.; John F. O'Rourke

(57) ABSTRACT

Apparatus and method for a power-saving shredder, including motorized shredder blades; a shredder controller coupled to the motor controller; a timer coupled to the motor controller, and a mechanically-actuated switch (GREEN SWITCH) couples to the shredder controller. The GREEN SWITCH causes the shredder controller, the motor controller, the motorized shredder blades, and the timer to be activated. The Normally Off switch, when deactuated, causes motorized shredder blades to deactivate. A method of operating a paper shredder includes operating a mechanical actuation switch ON; applying power to paper shredder electrical and electronic elements by operating the mechanical actuation switch; setting a timer for a predetermined active period; operating motorized paper shredder blades by operating the mechanical actuation switch ON; operating the mechanical actuation switch OFF; counting by the timer the predetermined active period; and if the predetermined active period has expired, removing power from the paper shredder electrical and electronic elements.

14 Claims, 4 Drawing Sheets

(56) References Cited

U.S. PATENT DOCUMENTS 3,947,734 A 3/1976 Fyler
3,952,239 A 4/1976 Owings et al.
3,953,696 A 4/1976 Reimann et al.
3,971,906 A 7/1976 Sahrbacker
4,002,874 A 1/1977 Brown
4,016,490 A 4/1977 Weckenmann et al.
4,018,392 A 4/1977 Wagner
4,062,282 A 12/1977 Miller et al.
4,068,805 A 1/1978 Oswald
4,082,232 A 4/1978 Brewer
4,107,484 A 8/1978 Petersen, III
4,117,752 A 10/1978 Yoneda
4,125,228 A 11/1978 Brewer
4,135,068 A 1/1979 Burns
4,162,042 A 7/1979 Mommsen et al.
4,172,400 A 10/1979 Brierley
4,180,716 A 12/1979 Suzuki
4,187,420 A 2/1980 Piber
4,194,698 A 3/1980 Kosmowski
4,262,179 A 4/1981 Bauer
4,276,459 A 6/1981 Willett et al.
4,277,666 A 7/1981 Vignaud
4,349,814 A 9/1982 Akehurst
4,423,844 A 1/1984 Sours et al.
4,449,062 A 5/1984 Wilson
4,471,915 A 9/1984 Levin et al.
4,510,860 A 4/1985 LaBarge et al.
4,518,958 A 5/1985 Cook et al.
4,549,097 A 10/1985 Ulmer
4,562,971 A 1/1986 Schwelling
4,564,146 A 1/1986 Bleasdale
4,598,182 A 7/1986 Breslin
4,664,317 A 5/1987 Morton
4,673,136 A 6/1987 Bianco et al.
4,683,381 A 7/1987 Dufoug
4,693,428 A 9/1987 Raterman et al.
4,706,895 A 11/1987 Bricker
4,709,197 A 11/1987 Goldhammer et al.
4,713,509 A 12/1987 Chebowski
4,751,603 A 6/1988 Kwan
4,753,323 A 6/1988 Kahkipuro
4,767,895 A 8/1988 Parrish
4,771,359 A 9/1988 Link
4,784,601 A 11/1988 Nitta
4,784,602 A 11/1988 Nitta
4,798,116 A 1/1989 Silver et al.
4,821,967 A 4/1989 Moriyama
4,824,029 A 4/1989 Stottmann et al.
4,839,533 A 6/1989 Aga
4,859,172 A 8/1989 Nitta
4,882,458 A 11/1989 Berg et al.
4,893,027 A 1/1990 Kammerer et al.
4,900,881 A 2/1990 Fischer
4,910,365 A 3/1990 Kuo
4,944,462 A 7/1990 Raterman et al.
4,957,243 A * 9/1990 Kanagaki et al. ..... 241/34
4,982,058 A 1/1991 Schroeder et al.
5,037,033 A 8/1991 Stottmann et al.
5,044,270 A 9/1991 Schwelling
5,045,648 A 9/1991 Fogleman, Sr.
5,065,947 A 11/1991 Farnsworth
5,081,406 A 1/1992 Hughes et al.
5,100,067 A 3/1992 Konig et al.
5,135,178 A 8/1992 Strohmeyer
5,166,679 A 11/1992 Vranish et al.
5,167,374 A 12/1992 Strohmeyer
5,171,143 A 12/1992 Sohn
5,186,398 A 2/1993 Vigneaux, Jr.
5,207,392 A 5/1993 Stangenberg et al.
5,236,138 A 8/1993 Stangenberg et al.
5,252,904 A * 10/1993 Nanos ..... 318/739
5,268,553 A 12/1993 Shimoji
5,269,473 A 12/1993 Strohmeyer et al.
5,275,342 A 1/1994 Galanty
5,279,467 A 1/1994 Lydy
5,295,633 A 3/1994 Kimbro et al.
5,318,229 A 6/1994 Brown
D348,431 S 7/1994 Hoffman
5,345,138 A 9/1994 Mukaidono et al.
5,356,286 A 10/1994 Sher
5,397,890 A 3/1995 Schueler et al.
5,407,346 A 4/1995 Sher
5,421,720 A 6/1995 Sher
5,432,308 A 7/1995 Howie, Jr.
5,436,613 A 7/1995 Ghosh et al.
5,460,516 A 10/1995 Sher
5,494,229 A 2/1996 Rokos et al.
5,568,895 A 10/1996 Webb et al.
5,607,295 A 3/1997 Khemarangsan
5,621,290 A 4/1997 Heller et al.
5,636,801 A 6/1997 Kroger
5,655,725 A 8/1997 Kroger
5,662,280 A 9/1997 Nishio et al.
5,667,152 A 9/1997 Mooring
5,680,999 A 10/1997 Wada
5,704,776 A 1/1998 Sher
5,724,737 A 3/1998 Stones
5,775,605 A 7/1998 Tsai
5,788,476 A 8/1998 Sher
5,829,697 A 11/1998 Kroger
5,829,963 A 11/1998 Ichikawa
5,850,342 A 12/1998 Nakamura et al.
5,868,242 A 2/1999 Hall et al.
5,884,855 A 3/1999 Chang
5,897,065 A 4/1999 Schwelling
5,921,367 A 7/1999 Kashioka et al.
D412,716 S 8/1999 Kroger
5,942,975 A 8/1999 Sørensen
5,988,542 A 11/1999 Henreckson et al.
6,016,020 A * 1/2000 Cline et al. ..... 307/125
6,065,696 A 5/2000 Tsai
6,079,645 A 6/2000 Henreckson et al.
6,082,643 A 7/2000 Kovacs
6,082,644 A 7/2000 Turner
6,089,482 A 7/2000 Chang
6,113,017 A 9/2000 Tsai
6,116,528 A 9/2000 Schwelling
6,247,828 B1 6/2001 Herst
D444,809 S 7/2001 Chang
6,260,780 B1 7/2001 Kroger et al.
6,265,682 B1 7/2001 Lee
6,274,828 B1 8/2001 Chu
6,308,904 B1 10/2001 Chang
6,325,309 B1 12/2001 Chang
6,340,124 B1 1/2002 Charles et al.
6,376,939 B1 4/2002 Suzuki et al.
6,418,004 B1 7/2002 Mather et al.
6,501,198 B2 12/2002 Taylor et al.
6,536,536 B1 3/2003 Gass et al.
6,550,701 B1 4/2003 Chang
6,575,285 B2 6/2003 Jong
D481,416 S 10/2003 Chang
6,629,654 B2 10/2003 Neely et al.
6,655,943 B1 12/2003 Peterson et al.
6,676,050 B2 1/2004 Chang
6,676,460 B1 1/2004 Motsenbocker
6,724,324 B1 4/2004 Lambert
D494,607 S 8/2004 Huang
6,775,018 B1 8/2004 Taniguchi
6,779,747 B2 8/2004 McLean et al.
6,813,983 B2 11/2004 Gass et al.
6,822,698 B2 11/2004 Clapper
6,826,988 B2 12/2004 Gass et al.
6,834,730 B2 12/2004 Gass et al.
6,857,345 B2 2/2005 Gass et al.
D502,713 S 3/2005 Huang
D502,714 S 3/2005 Huang
6,877,410 B2 4/2005 Gass et al.
6,880,440 B2 4/2005 Gass et al.
6,920,814 B2 7/2005 Gass et al.
6,922,153 B2 7/2005 Pierga et al.
6,945,148 B2 9/2005 Gass et al.
6,945,149 B2 9/2005 Gass et al.
6,957,601 B2 10/2005 Gass et al.

(56) References Cited

U.S. PATENT DOCUMENTS

| | | | | |
|---|---|---|---|---|
| 6,962,301 | B1 | 11/2005 | Chang | |
| 6,966,513 | B2 | 11/2005 | Chang | |
| 6,976,648 | B2 | 12/2005 | Chang | |
| 6,978,954 | B2 | 12/2005 | Kroeger et al. | |
| 6,979,813 | B2 | 12/2005 | Avril | |
| 6,981,667 | B2 | 1/2006 | Hunag | |
| 6,983,903 | B2 | 1/2006 | Chang | |
| 6,994,004 | B2 | 2/2006 | Gass et al. | |
| 6,997,090 | B2 | 2/2006 | Gass et al. | |
| 7,000,514 | B2 | 2/2006 | Gass et al. | |
| 7,024,975 | B2 | 4/2006 | Gass et al. | |
| 7,040,559 | B2 | 5/2006 | Matlin et al. | |
| 7,044,410 | B2 | 5/2006 | Huang | |
| 7,048,218 | B2 | 5/2006 | Huang | |
| 7,055,417 | B1 | 6/2006 | Gass | |
| 7,077,039 | B2 | 7/2006 | Gass et al. | |
| 7,083,129 | B2 | 8/2006 | Beam, III | |
| 7,093,668 | B2 | 8/2006 | Gass et al. | |
| 7,098,800 | B2 | 8/2006 | Gass | |
| 7,100,483 | B2 | 9/2006 | Gass et al. | |
| 7,121,358 | B2 | 10/2006 | Gass et al. | |
| 7,137,326 | B2 | 11/2006 | Gass et al. | |
| 7,150,422 | B2 | 12/2006 | Wang | |
| 7,156,330 | B1 | 1/2007 | Lo | |
| 7,171,879 | B2 | 2/2007 | Gass et al. | |
| 7,171,897 | B2 | 2/2007 | Barajas et al. | |
| 7,195,185 | B2 | 3/2007 | Matlin | |
| 7,197,969 | B2 | 4/2007 | Gass et al. | |
| 7,210,383 | B2 | 5/2007 | Gass et al | |
| 7,225,712 | B2 | 6/2007 | Gass et al. | |
| 7,228,772 | B2 | 6/2007 | Gass | |
| 7,231,856 | B2 | 6/2007 | Gass et al. | |
| 7,284,467 | B2 | 10/2007 | Gass et al. | |
| 7,290,472 | B2 | 11/2007 | Gass et al. | |
| 7,308,843 | B2 | 12/2007 | Gass et al. | |
| 7,311,276 | B2 | 12/2007 | Matlin | |
| 7,328,752 | B2 | 2/2008 | Gass et al. | |
| 7,344,096 | B2 | 3/2008 | Matlin et al. | |
| D583,859 | S | 12/2008 | Holderfield | |
| D584,342 | S | 1/2009 | Parratt | |
| D591,335 | S | 4/2009 | Holderfield et al. | |
| 7,520,452 | B2 * | 4/2009 | Watano et al. | 241/36 |
| 7,594,620 | B2 * | 9/2009 | Abramson et al. | 241/36 |
| 7,631,822 | B2 | 12/2009 | Matlin et al. | |
| 7,631,823 | B2 | 12/2009 | Matlin et al. | |
| 7,631,824 | B2 | 12/2009 | Matlin et al. | |
| 7,635,102 | B2 | 12/2009 | Matlin et al. | |
| 7,828,235 | B2 * | 11/2010 | Matlin et al. | 241/34 |
| 7,971,812 | B2 | 7/2011 | Huang | |
| 2001/0030114 | A1 | 10/2001 | Thielman | |
| 2002/0002942 | A1 | 1/2002 | Abraham et al. | |
| 2002/0017175 | A1 | 2/2002 | Gass et al. | |
| 2002/0017176 | A1 | 2/2002 | Gass et al. | |
| 2002/0017178 | A1 | 2/2002 | Gass et al. | |
| 2002/0017179 | A1 | 2/2002 | Gass et al. | |
| 2002/0017180 | A1 | 2/2002 | Gass et al. | |
| 2002/0017181 | A1 | 2/2002 | Gass et al. | |
| 2002/0017182 | A1 | 2/2002 | Gass et al. | |
| 2002/0017183 | A1 | 2/2002 | Gass et al. | |
| 2002/0017184 | A1 | 2/2002 | Gass et al. | |
| 2002/0017336 | A1 | 2/2002 | Gass et al. | |
| 2002/0020261 | A1 | 2/2002 | Gass et al. | |
| 2002/0020262 | A1 | 2/2002 | Gass et al. | |
| 2002/0020263 | A1 | 2/2002 | Gass et al. | |
| 2002/0020265 | A1 | 2/2002 | Gass et al. | |
| 2002/0056348 | A1 | 5/2002 | Gass et al. | |
| 2002/0056349 | A1 | 5/2002 | Gass et al. | |
| 2002/0056350 | A1 | 5/2002 | Gass et al. | |
| 2002/0059853 | A1 | 5/2002 | Gass et al. | |
| 2002/0059854 | A1 | 5/2002 | Gass et al. | |
| 2002/0059855 | A1 | 5/2002 | Gass et al. | |
| 2002/0066346 | A1 | 6/2002 | Gass et al. | |
| 2002/0069734 | A1 | 6/2002 | Gass et al. | |
| 2002/0111702 | A1 | 8/2002 | Angel | |
| 2002/0139877 | A1 | 10/2002 | Beam | |
| 2002/0170399 | A1 | 11/2002 | Gass et al. | |
| 2002/0170400 | A1 | 11/2002 | Gass | |
| 2002/0190581 | A1 | 12/2002 | Gass et al. | |
| 2003/0002942 | A1 | 1/2003 | Gass et al. | |
| 2003/0005588 | A1 | 1/2003 | Gass et al. | |
| 2003/0015253 | A1 | 1/2003 | Gass et al. | |
| 2003/0019341 | A1 | 1/2003 | Gass et al. | |
| 2003/0037651 | A1 | 2/2003 | Gass et al. | |
| 2003/0056853 | A1 | 3/2003 | Gass et al. | |
| 2003/0058121 | A1 | 3/2003 | Gass et al. | |
| 2003/0090224 | A1 | 5/2003 | Gass et al. | |
| 2003/0090226 | A1 | 5/2003 | Chen et al. | |
| 2003/0196824 | A1 | 10/2003 | Gass et al. | |
| 2004/0008122 | A1 | 1/2004 | Michael | |
| 2004/0040426 | A1 | 3/2004 | Gass et al. | |
| 2004/0043696 | A1 | 3/2004 | Suzuki | |
| 2004/0163514 | A1 | 8/2004 | Gass et al. | |
| 2004/0173430 | A1 | 9/2004 | Gass | |
| 2004/0181951 | A1 | 9/2004 | Wittke | |
| 2004/0194594 | A1 | 10/2004 | Dils et al. | |
| 2004/0226800 | A1 | 11/2004 | Pierga et al. | |
| 2005/0039586 | A1 | 2/2005 | Gass et al. | |
| 2005/0039822 | A1 | 2/2005 | Gass et al. | |
| 2005/0041359 | A1 | 2/2005 | Gass | |
| 2005/0132859 | A1 | 6/2005 | Hunag | |
| 2005/0157203 | A1 | 7/2005 | Nakakuki et al. | |
| 2005/0166736 | A1 | 8/2005 | Gass et al. | |
| 2005/0218250 | A1 | 10/2005 | Matlin et al. | |
| 2005/0274834 | A1 | 12/2005 | Huang | |
| 2005/0274836 | A1 | 12/2005 | Chang | |
| 2006/0011759 | A1 * | 1/2006 | Chavez | 241/46.013 |
| 2006/0027689 | A1 * | 2/2006 | Watano et al. | 241/36 |
| 2006/0091247 | A1 | 5/2006 | Matlin | |
| 2006/0157600 | A1 | 7/2006 | Wang | |
| 2006/0169619 | A1 | 8/2006 | Wang | |
| 2006/0249609 | A1 | 11/2006 | Huang | |
| 2007/0246582 | A1 | 10/2007 | Aries et al. | |
| 2007/0290083 | A1 | 12/2007 | Abramson et al. | |
| 2009/0026294 | A1 * | 1/2009 | Abramson et al. | 241/36 |
| 2009/0283617 | A1 * | 11/2009 | Abramson et al. | 241/30 |
| 2010/0327091 | A1 * | 12/2010 | Ko | 241/25 |
| 2011/0133008 | A1 * | 6/2011 | Chen et al. | 241/36 |

FOREIGN PATENT DOCUMENTS

| | | |
|---|---|---|
| DE | 3733413 | 3/1943 |
| DE | 7818838 | 11/1979 |
| DE | 3247299 | 7/1984 |
| DE | 3313232 | 10/1984 |
| DE | 3208676 | 4/1986 |
| DE | 3540896 | 5/1987 |
| DE | 8619856 | 9/1988 |
| DE | 8619856 | 10/1988 |
| DE | 3819285 | 12/1989 |
| DE | 4014669 | 11/1991 |
| DE | 4121330 | 1/1993 |
| DE | 19519858 | 5/1996 |
| DE | 19703575 | 8/1998 |
| DE | 19960267 | 7/2000 |
| EP | 0191137 | 8/1986 |
| EP | 0511535 | 4/1992 |
| EP | 00522071 | 5/1993 |
| EP | 0562076 | 9/1993 |
| EP | 0736886 | 10/1996 |
| EP | 0855221 | 7/1998 |
| EP | 855221 | 7/1998 |
| EP | 1069954 | 1/2001 |
| EP | 1195202 | 4/2002 |
| EP | 1442834 | 4/2004 |
| GB | 2096919 | 10/1982 |
| GB | 2199962 | 7/1988 |
| GB | 2203063 | 10/1988 |
| GB | 2234690 | 2/1991 |
| JP | 52011691 | 1/1977 |
| JP | 57076734 | 5/1982 |
| JP | 62146877 | 6/1987 |
| JP | 3143552 | 6/1991 |
| JP | 4110143 | 4/1992 |
| JP | 03143552 | 5/1992 |

(56) References Cited

FOREIGN PATENT DOCUMENTS

| | | | |
|---|---|---|---|
| JP | 04110143 | | 5/1992 |
| JP | 04157093 | | 5/1992 |
| JP | 04180852 | | 6/1992 |
| JP | 05014164 | | 1/1993 |
| JP | 05068906 | | 3/1993 |
| JP | 05092144 | | 4/1993 |
| JP | 05123593 | | 5/1993 |
| JP | 05211691 | | 8/1993 |
| JP | 05280243 | | 10/1993 |
| JP | 06137104 | | 5/1994 |
| JP | 06277548 | | 10/1994 |
| JP | 07039778 | | 5/1995 |
| JP | 07136539 | | 5/1995 |
| JP | 07155629 | A2 | 6/1995 |
| JP | 07157012 | A2 | 6/1995 |
| JP | 07299377 | A2 | 11/1995 |
| JP | 07328469 | A2 | 12/1995 |
| JP | 8001026 | | 1/1996 |
| JP | 09070551 | A2 | 3/1997 |
| JP | 09075763 | A2 | 3/1997 |
| JP | 09139161 | A2 | 5/1997 |
| JP | 09262491 | A2 | 10/1997 |
| JP | 10-048344 | | 2/1998 |
| JP | 10034003 | A2 | 2/1998 |
| JP | 10-089592 | | 4/1998 |
| JP | 11216383 | A2 | 8/1999 |
| JP | 20076014 | | 3/2000 |
| JP | 20346288 | | 12/2000 |
| JP | 2001150383 | A2 | 6/2001 |
| JP | 2001-349139 | | 12/2001 |
| JP | 21349139 | | 12/2001 |
| JP | 24321993 | | 11/2004 |
| JP | 200432199 | A2 | 11/2004 |
| JP | 26075831 | | 3/2006 |
| JP | 2007-075822 | | 3/2007 |
| JP | 27075822 | | 3/2007 |
| WO | WO8403650 | | 9/1984 |
| WO | WO9101860 | | 2/1991 |
| WO | WO92/00159 | | 1/1992 |
| WO | WO9306570 | | 4/1993 |
| WO | WO9308356 | | 4/1993 |
| WO | WO94/13441 | | 6/1994 |
| WO | WO9413441 | | 6/1994 |
| WO | WO9613362 | | 5/1996 |
| WO | WO9637350 | | 11/1996 |
| WO | WO9852728 | | 11/1998 |
| WO | WO0048283 | | 8/2000 |
| WO | WO02060588 | | 8/2002 |
| WO | WO02/082613 | | 10/2002 |
| WO | WO2003/006213 | | 1/2003 |
| WO | WO2005-084861 | | 9/2005 |
| WO | WO2005097331 | | 10/2005 |
| WO | WO2005107951 | | 11/2005 |
| WO | WO2006049784 | | 1/2006 |
| WO | US2005/028290 | | 3/2006 |
| WO | WO2006/031324 | | 3/2006 |
| WO | WO2006031324 | | 3/2006 |
| WO | WO2006074122 | | 7/2006 |
| WO | WO2007/060698 | | 5/2007 |
| WO | WO2007/109753 | | 9/2007 |
| WO | WO2008/011517 | | 1/2008 |
| WO | WO2008/014276 | | 1/2008 |
| WO | WO2008/042538 | | 4/2008 |
| WO | WO2008/064392 | | 6/2008 |

OTHER PUBLICATIONS

D.S. Chauhan & P.H. Dehoff, a magneto-sensitive skin for robots in space, Dept. of Mechanical Engineering & Engineering Science University of North Carolina at Charlotte, Jul. 1991.

Thomas G. Zimmerman et al., applying electric field sensing to human-computer interfaces, MIT Media Laboratory Physics and Media Group.

Proximity Sensors (book), Festo Didactic, Germany 2003.

Lennart Bavall & Nils Karlsson, capacitive detection of humans for safety in industry—a numerical and experimental investigation, Linkoping Institute of Tech., Sweden Oct. 1997.

Concepts and techniques of machine safeguarding, US Dept. of Labor, OSHA 3067, 1992.

Designing a safe highly productive system, thefabricator.com, May 30, 2002.

Joshua Smith et al., Electric Field Sensing for graphical interfaces, May/Jun. 1998.

TI's Digital signal Controllers put brake on sawstop table saw, www.embeddedstar.com, 2005.

Doubled productivity reduced product damage, Gorbel Inc., 2003.

Andrew J. Scarlett et al., Guard interlockling for self-propelled harvesting machinery, Silsoe Research Institute, HSE Book 2002.

Industrial Guarding Program Energy Sources Machinery Equipment and Materials, OFSWA Sep. 2002 Version 1.0.

Navigating the maze of proximit sensor selection, Allen-Bradley, Sensors Today, vol. 2 Issue 1.

The Limitations of Radiofrequency Presence Sensing Device, US Dept. of Labor, OSHA, Sep. 21, 1987.

Charge-Transfer Touch Sensor, Quantum Research Group Ltd, 2001.

Safety Mats, Presence Sensing Safety Devices, Allen-Bradley, 2-72.

Tom Begnal, Sawstop and bandsaws might soon be an option, Taunton 2008.

Safeguarding woodworking machines and worker safety, tablesaw blade safety device, Woodweb forum, 2008.

Nils Karlsson, Theory and application of a capacitive sensor for safeguarding in industry, Dept. of Physics and Measurement Techology, Mar. 1994.

* cited by examiner

DEPOWERED STANDBY PAPER SHREDDER AND METHOD

BACKGROUND

1. Field of the Invention

The invention is related to paper shredders and in particular, to power-saving paper shredders.

2. Background of the Art

Increasingly, energy-saving configurations of modern electric and electronic devices are becoming more desirable. Typically, an electric device is equipped with an ON/OFF switch corresponding to POWER ON/POWEROFF states respectively. In the POWER ON state, in an operational mode, the main functional parts of a machine become operable during a task. This typically operates the machine with near-maximal power consumption. After the task is complete, the machine shifts to a POWER ON-STANDBY (STANDBY) state, during which at least a portion of the electric circuitry of the machine remains energized, awaiting a cue to resume the operational mode state. Oftentimes, machines remain in the POWER ON/STANDBY state often for many hours per week as a convenience to the user. This convenience bears the cost of a constant, if lower level, of energy consumption. Masses of these products, in the aggregate, wastefully consume substantial amounts of energy, creating a background level of non-purposeful energy consumption. Paper shredders typically have ON/OFF/STANDBY states and remain at least partially energized while in STANDBY state. A powerless standby mode is useful.

SUMMARY OF THE INVENTION

Embodiments provide apparatus and method for a power-saving shredder that comminutes shreddant, including motorized shredder blades to comminute shreddant when activated; a motor controller coupled to the motorized shredder blades; a shredder controller coupled to the motor controller; a timer coupled to the motor controller, wherein the timer is activated over a predetermined active period; and a mechanically-actuated switch (GREEN SWITCH) coupled to the shredder controller.

The GREEN SWITCH while actuated causes the shredder controller, the motor controller, the motorized shredder blades, and the timer to be activated. The GREEN SWITCH causes the motorized shredder blades to become deactivated when deactuated. The GREEN SWITCH is a Normally Off switch. The timer causes power to be removed from the shredder controller, the motor controller, and the motorized shredder blades upon expiration of the predetermined active period.

Certain embodiments have a predetermined active period being less than about one hour. In other embodiments, the predetermined active period is less than about five minutes. In yet other embodiments, wherein the mechanically-actuated switch comprises a single pole, single throw switch. In still other embodiments, the mechanically-actuated switch is a mechanically-actuated switch trip switch and, in some cases, the mechanically-actuated switch is a single pole, single throw, trip switch and wherein the predetermined active period comprises less than about one hour. In some embodiments, the mechanically-actuated switch is disposed in a paper feed inlet opening throat.

In still another embodiment, a shredder for comminuting shreddant, includes motorized shredder blades to comminute shreddant when activated; a motor controller coupled to the motorized shredder blades; a shredder controller coupled to the motor controller, including a timer coupled therein, wherein the timer is activated over a predetermined active period; a power enable/disable (PED) switch to provide electric power to the motorized shredder blades, the motor controller, and the shredder controller with a timer when in the power enabled state; and a mechanically-actuated switch (GREEN SWITCH) coupled to the shredder controller.

The GREEN SWITCH while actuated causes the shredder controller, the motor controller, the motorized shredder blades, and the timer to be activated. The GREEN SWITCH causes the motorized shredder blades to become deactivated when deactuated. The GREEN SWITCH is a Normally Off switch. Typically, the timer causes power to be removed from the shredder controller, the motor controller, and the motorized shredder blades upon expiration of the predetermined active period.

In embodiments, the shredder with the mechanically-actuated switch includes a single pole, single throw, trip switch and the predetermined active period comprises less than about one hour. In other embodiments, the mechanically-actuated switch comprises a single pole, single throw switch and the predetermined active period comprises about five minutes.

An example method of operating a paper shredder is provided, including operating a mechanical actuation switch ON; applying power to paper shredder electrical and electronic elements by operating the mechanical actuation switch; setting a timer for a predetermined active period; operating motorized paper shredder blades by operating the mechanical actuation switch ON; operating the mechanical actuation switch OFF; counting by the timer the predetermined active period; and if the predetermined active period has expired, removing power from the paper shredder electrical and electronic elements. In some of these embodiments, operating a mechanical actuation switch ON further comprises operating a mechanical actuation switch ON in the paper shredder feed inlet throat. In other embodiments, before operating the mechanical actuation switch ON, enabling power to the paper shredder using a power enable/disable switch. The method also can include after the operating the mechanical actuation switch ON, sensing a shreddant in the paper feed inlet. In particular matters, electro-optically sensing a shreddant in the paper feed inlet may be performed.

Described herein are example embodiments of a paper shredder having a depowered standby state.

BRIEF DESCRIPTION OF THE FIGURES

Embodiment of the present invention disclosed herein are illustrated by way of example, and are not limited by the accompanying figures, in which like references indicate similar elements, and in which.

Skilled artisans can appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE EMBODIMENTS

Embodiments disclosed herein disclose a paper shredder that has ON/OFF/STANDBY states and a POWERLESS STANDBY (GREEN) state as well. When powered ON, the shredder can enter a POWERED STANDBY state for a predetermined active period, prepared for imminent shredder functioning. After a predetermined period without operation, the shredder is directed to the GREEN state, upon expiration of the active period. In the GREEN state, all power to shredder motor and control electronics is removed and the shredded is powered down. However, the shredder can be made to operate (i.e., "be awakened"), simply by placing shreddant in the paper feed inlet and actuating the mechanical actuation switch. Thus, no power is required in the depowered standby state.

A mechanically-actuated trip switch (GREEN SWITCH) may be used as a mechanical wake-up switch to power up the shredder, and to allow POWER ON functioning for a limited, predetermined active period. The GREEN SWITCH may be a single pole, single throw, normally open (OFF) switch, including one of a trip switch, a micro-switch, or any type of mechanical switch sensitive enough to detect the presence of a shreddant. For convenient use, the GREEN SWITCH may be disposed at the feed inlet opening or in the throat of the shredder to prevent accidental actuation. In contrast to an electro-optical switch, the GREEN SWITCH of the present embodiments consumes no power itself, and does not require sentinel or monitor electronics to be powered up to sense paper feed and to power the shredder circuitry. An electro-optical switch may be used to sense the presence of shreddant in the shredder feed throat during the active period but it, too, can be powered down after the active period has expired. The GREEN SWITCH then can be used to restore power for shredding when shreddant is present at the (normally open) GREEN SWITCH. Alternatively, the GREEN SWITCH may be used in place of the electro-optical switch, or other shredder operation sensor, so that the shredder has few parts, less complexity, and greater economy.

Figure 1:
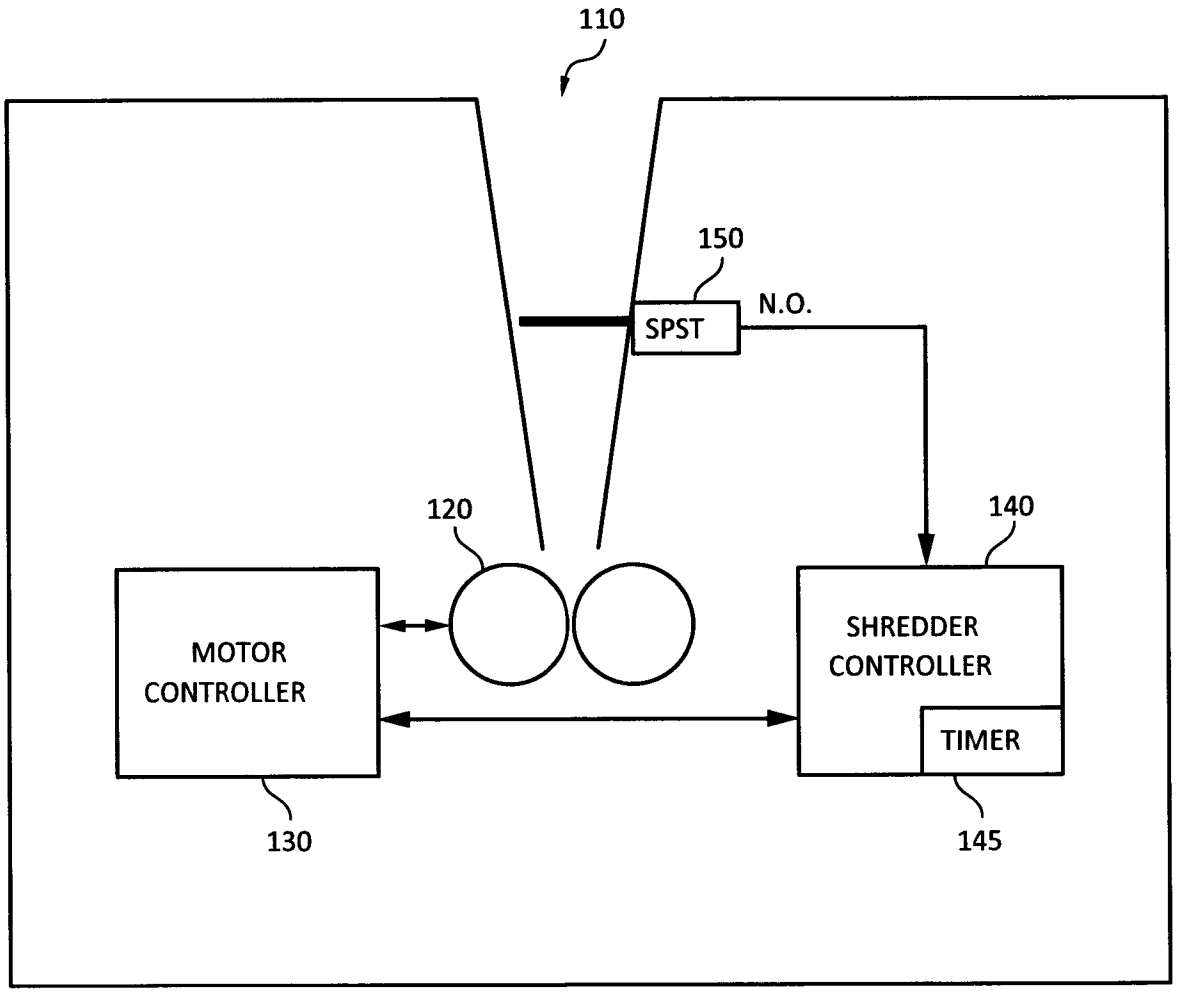
FIG. 1 is an embodiment of a depowered standby paper shredder, in accordance with the teachings of the present invention.

FIG. 1 is an example embodiment of shredder 100 using GREEN SWITCH 150 to admit power to the shredder controller 140, motor controller 130, and motorized shredder blades 120. Shredder 100 includes a feed opening inlet, with a throat, generally at 110, motorized shredder blades 120, motor controller 130, and shredder controller 140. Controller 140 can include a timer 145, which can be used to control a predetermined active period. The predetermined active period can be controlled to limit the amount of time controllers 130, 140 are empowered with electricity. Upon expiration of the predetermined active period, for example up, less than one hour, power is disconnected from the controllers 130, 140 and the motorized shredder blades 120. Unlike shredder 200, shredder 100 does not include a PED switch, such as PED switch 270. Also, shredder 100 may not include an electro-optic sensor, such as electro-optic device 260.

Instead, application of power to shredder 100 can be initiated by actuation of the GREEN SWITCH 150 located in throat 110, and can be deactivated upon expiration of the predetermined active period as sensed by timer 145. Shredder blades 120 can be activated during mechanical operation (e.g., deflection) of GREEN SWITCH 150. After GREEN SWITCH 150 returns to its base state (e.g., undeflected), shredder 100 may enter a powered STANDBY state for the duration of the predetermined active period. Timer 145 is configured to signal shredder controller 140 to remove power from shredder 100, including motorized shredder blades 120, motor controller 130, and shredder controller 140. Of course, neither shredder 100 nor shredder 200 is required to have discrete controllers 130, 140, or 230, 240, respectively, but one or both may have an integrated controller. Even so, controller 140 is operatively coupled to controller 130 and through controller 130, to motorized shredder blades 120.

Figure 2:
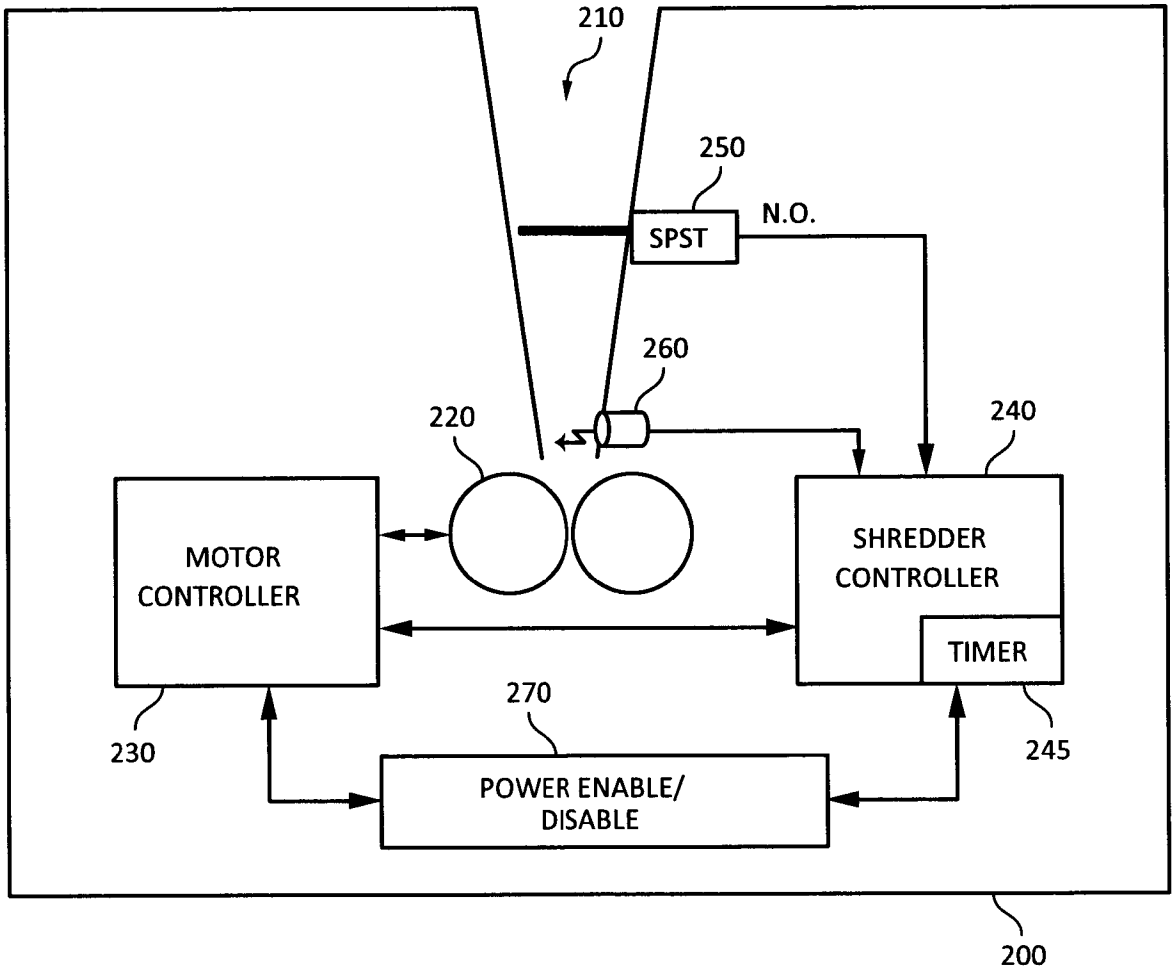
FIG. 2 is another embodiment of a depowered standby paper shredder, in accordance with the teachings of the present invention.

Turning to FIG. 2, example embodiment shredder 200 can include a feed throat generally at 210, motorized shredder blades 220, motor controller 230 to provide electrical power to the shredder motor, shredder controller 240 operatively coupled to motor controller 230, mechanically-operated switch 250 operatively coupled to shredder controller 240 and, in some embodiments, electro-optical sensor 260 also operatively coupled to shredder controller 240. Power is enabled or disabled by power enable/disable (PED) switch 270. PED switch 270 allows power to be available or unavailable to the controllers 230, 240 in accordance with the operation of GREEN SWITCH 250. A timer 245 is provided to turn power off to motorized shredder blades 220, motor controller 230 and shredder controller 240 after a predetermined active period, for example, a predetermined active period of 5 minutes. Other predetermined active periods are contemplated.

Once power is turned off to controllers 230, 240, power can be restored to controllers 230, 240 and motor 220 after operation of GREEN SWITCH 250. Such a configuration can reduce the amount of standby power used by shredder 200 during long period of non-use. By contrast, existing shredders would remain at least partly powered up, for example, at least part of the shredder controller of an existing shredder would consume energy, for hours or longer, until the shredder power switch was turned off. PED switch 270 allows or prevents power to flow to the controllers 230, 240 and motors 220. However, no power is provided to these elements until activated by the GREEN SWITCH 250 or during a predetermined active period.

Figure 3:
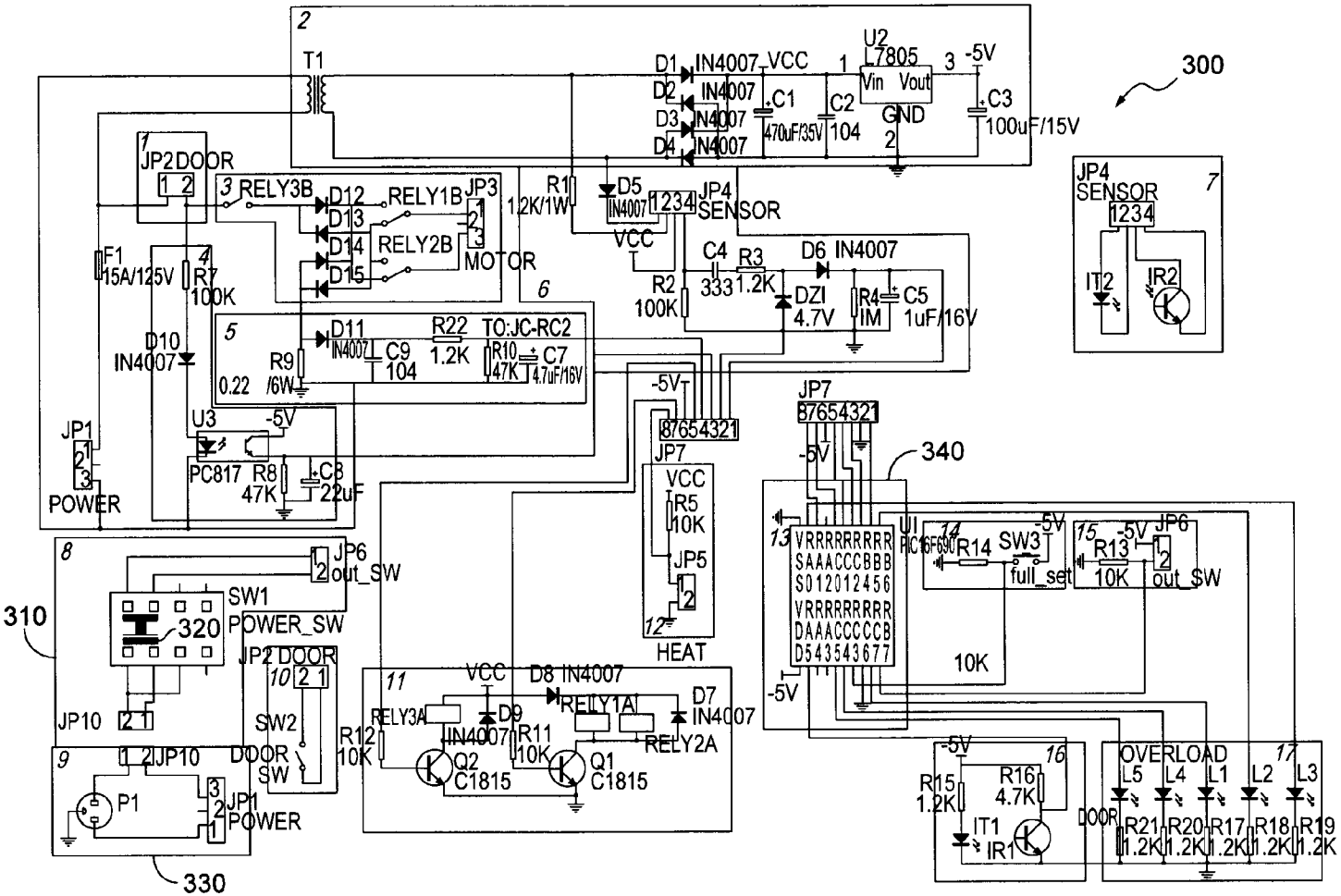
FIG. 3 is a schematic diagram of a shredder control system for depowered standby paper shredder, in accordance with the teachings of the present invention.

FIG. 3 depicts an example schematic diagram for a shredder 300, in accordance with the teachings herein. Assembly block 8 includes switch assembly 310 having a mechanically-actuated switch 320. Assembly block 9 includes power module 330. When switch 320 is actuated, an electrical path is completed through power module 330, and the electromechanical elements of shredder 300 are electrically energized. When switch 320 is deactuated, microcontroller 340 can count elapsed time for the predetermined active period to maintain powered standby, then change states into the depowered standby state. Microcontroller 340 in assembly block 13 can control, at least in part, the shredder controller and the shredder motor controller. Microcontroller 340 can be a PIC16F690 20-Pin Flash-Based, 8-Bit CMOS Microcontroller, produced by Microchip Technology Inc., Chandler, Ariz., USA. Microcontroller 340 can provide timing, command, and control functions of shredder 300. Indeed, microcontroller 340 can include a timer used to measure the predetermined active period.

Figure 4:
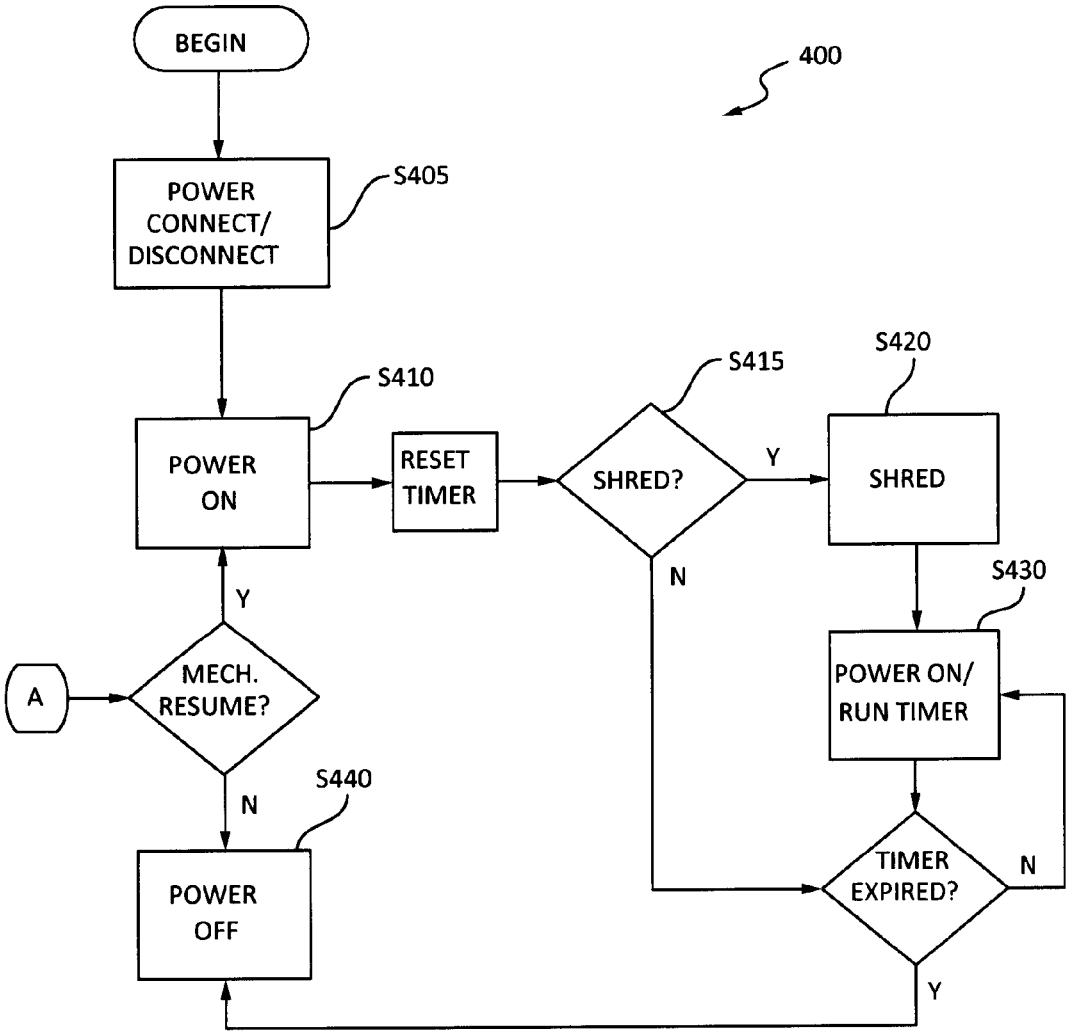
FIG. 4 is a flow diagram for a method of operating a depowered standby paper shredder, in accordance with the teachings of the present invention.

Turning to FIG. 4, an example method of operating a shredder with a GREEN switch (400) is given, in accordance with the present embodiments. Method 400 may begin by allowing electrical power to be available to a shredder by connecting (S405) the shredder to the electrical main, for example, by a PEDS switch. Alternatively, connecting (S405) the shredder to the electrical main can be performed directly by a mechanically-actuated trip switch (GREEN SWITCH). Initially powering on (S410) shredder and motor controllers, the shredder begins a powered standby state for a limited, predetermined active period awaiting introduction of shreddant (S415) into the feed inlet opening. If shreddant is introduced, method 400 may proceed by powering up the shredder motor and shredding (S420) the introduced shreddant. Otherwise, a timer begins a counting a timer (S430) towards the expiration of a predetermined period.

If no shreddant is introduced while the shredder is powered up and during the predetermined active period, powering off (S440) all electrical (e.g., motorized shredder blades) and electronic (e.g., controllers), for example, by a timer limit signal, reduces power consumption of the shredder to zero. However, an act of inserting shreddant (S450) is a command by the user via the GREEN SWITCH to resuming shredder operation (S455), in which case, the shredder begins operating by powering on (S410) the electrical and electronic components as before. Otherwise, the shredder electricity remains off.

The embodiments of the present invention disclosed herein are intended to be illustrative only, and are not intended to limit the scope of the invention. It should be understood by those skilled in the art that various modifications and adaptations of the prevent invention as well as alternative embodiments of the prevent invention may be contemplated or foreseeable. It is to be understood that the present invention is not limited to the sole embodiments described above, but encompasses any and all embodiments within the scope of the following claims.

What is claimed is:

1. A shredder for comminuting shreddant, comprising:

motorized shredder blades to comminute shreddant when activated;

a motor controller coupled to the motorized shredder blades;

a shredder controller coupled to the motor controller;

a timer coupled to the motor controller, wherein the timer is activated over a predetermined active period; and a mechanically-actuated switch (GREEN SWITCH) coupled to the shredder controller, disposed in a paper feed inlet opening throat and covering at least a part of the inlet opening throat, wherein the GREEN SWITCH while actuated by inserting shreddant into the inlet opening throat causes the shredder controller, the motor controller, and the motorized shredder blades, to be activated, wherein shreddant is comminuted while motorized shredder blades are activated, wherein the GREEN SWITCH causes the motorized shredder blades to become deactivated when the GREEN SWITCH is deactuated by no shreddant being in the inlet opening throat, wherein the GREEN SWITCH, when first deactuated activates the timer, and wherein the timer causes power to be removed from the shredder controller, the motor controller, and the motorized shredder blades upon expiration of the predetermined active period.

2. The shredder of claim 1, wherein the predetermined active period comprises less than about one hour.

3. The shredder of claim 2, wherein the mechanically-actuated switch comprises a single pole, single throw, trip switch and wherein the predetermined active period comprises less than about one hour.

4. The shredder of claim 1, wherein the predetermined active period comprises less than about five minutes.

5. The shredder of claim 1, wherein the mechanically-actuated switch comprises a single pole, single throw switch.

6. The shredder of claim 1, wherein the mechanically-actuated switch comprises a mechanically-actuated switch trip switch.

7. A shredder for comminuting shreddant, comprising:

motorized shredder blades to comminute shreddant when activated;

a motor controller coupled to the motorized shredder blades;

a shredder controller coupled to the motor controller, including a timer coupled therein, wherein the timer is activated over a predetermined active period;

a power enable/disable (PED) switch to provide electric power to the motorized shredder blades, the motor controller, and the shredder controller when in the power enabled state; and a mechanically-actuated switch (GREEN SWITCH) coupled to the shredder controller, wherein the GREEN SWITCH while actuated by shreddant in a throat of the shredder causes the shredder controller, the motor controller, and the motorized shredder blades to be activated, wherein when the GREEN SWITCH is deactuated by no shreddant in the throat causes the motorized shredder blades to become deactivated and the timer to be activated for a predetermined active period, and wherein upon expiration of the predetermined active period the timer causes power to be removed from the shredder controller, the motor controller, and the motorized shredder blades.

8. The shredder of claim 7, wherein the mechanically-actuated switch comprises a single pole, single throw, trip switch and wherein the predetermined active period comprises less than about one hour.

9. The shredder of claim 7, wherein the mechanically-actuated switch comprises a single pole, single throw switch and wherein the predetermined active period comprises about five minutes.

10. A method of operating a paper shredder, comprising:

operating a mechanical actuation switch ON;

applying power to paper shredder electrical and electronic elements in response to operating the mechanical actuation switch ON;

operating motorized paper shredder blades by operating the mechanical actuation switch ON;

operating the mechanical actuation switch OFF;

setting a timer for a predetermined active period;

measuring by the timer the predetermined active period; and if the predetermined active period has expired, removing power from the paper shredder electrical and electronic elements.

11. The method of claim 10, wherein operating a mechanical actuation switch ON further comprises operating a mechanical actuation switch ON in the paper shredder feed inlet throat.

12. The method of claim 10, further comprising before operating the mechanical actuation switch ON, enabling power to the paper shredder using a power enable/disable switch.

13. The method of claim 10, further comprising:

after the operating the mechanical actuation switch ON, sensing a shreddant in the paper feed inlet.

14. The method of claim 13, further comprising electro-optically sensing a shreddant in the paper feed inlet after the operating the mechanical actuation switch ON.

* * * * *